US006071594A

United States Patent [19]

Penisten et al.

[11] Patent Number: 6,071,594

[45] Date of Patent: Jun. 6, 2000

[54] METAL, PROTECTIVE COATED APPLIANCE COMPONENT WITH ROUNDED, ELONGATED EDGE AND METHOD OF PRODUCING THE SAME

[75] Inventors: Thomas E. Penisten, Urbandale; Edwin F. Wegner, Newton, both of Iowa

[73] Assignee: Maytag Corporation, Newton, Iowa

[21] Appl. No.: 09/337,508

[22] Filed: Jun. 22, 1999

[51] Int. Cl.[7] ..... B32B 23/02

[52] U.S. Cl. ..... 428/192; 428/469; 428/472; 428/701; 428/702

[58] Field of Search ..... 428/469, 472, 428/701, 702, 192; 427/427

[56] References Cited

U.S. PATENT DOCUMENTS 3,702,112 11/1972 Keppler .
4,248,075 2/1981 Whitley .
4,542,037 9/1985 Delfino .

OTHER PUBLICATIONS

Thermal Arc Welding Handbook, Manual No. 300–2090, dated Jan. 10, 1986.

*Primary Examiner*—Deborah Jones
*Assistant Examiner*—Jason Resnick
*Attorney, Agent, or Firm*—Everett G. Diederiks, Jr.

[57] ABSTRACT

An appliance component is formed from sheet metal having a thickness defined by an elongated edge portion of the sheet metal. The elongated edge portion is rounded prior to applying a protective coating, such as a layer of porcelain enamel glass, to the component. Rounding of the elongated edge portions avoids the development of any thin or bare coating spots along the edge of the component which would be prone to rusting.

13 Claims, 1 Drawing Sheet

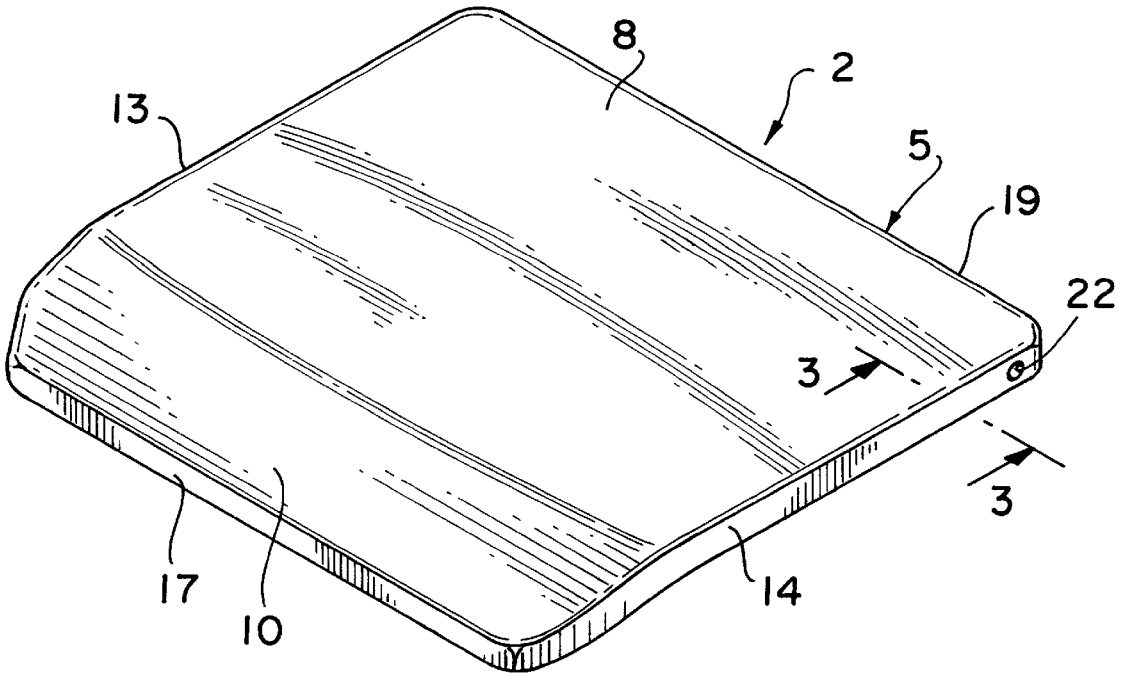
FIG. 1
FIG. 2
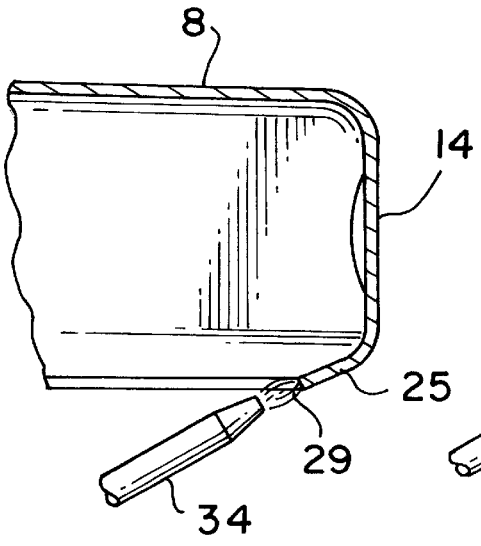
FIG. 3
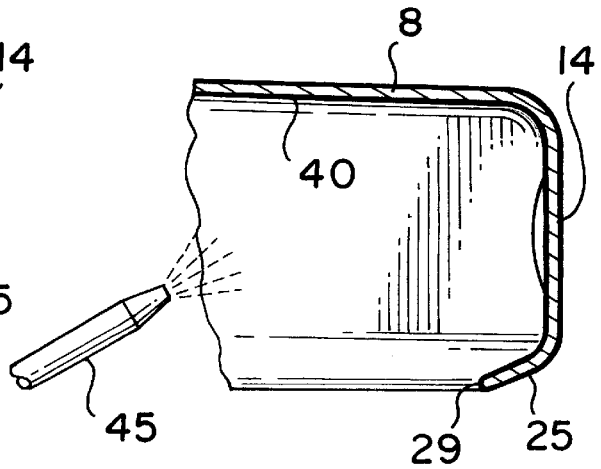

METAL, PROTECTIVE COATED APPLIANCE COMPONENT WITH ROUNDED, ELONGATED EDGE AND METHOD OF PRODUCING THE SAME

BACKGROUND OF THE INVENTION

1. Field of the Invention

The present invention pertains to the art of appliances and, more particularly, the making of appliance components from sheet metal with rounded, elongated edges to enhance the adherence of protective coatings.

2. Discussion of the Prior Art

It is known in the art to provide coatings on metal appliance components in order to both enhance the aesthetic appearance of the components and to protect against rusting and other corrosive factors. For instance, it is widely known to apply a porcelain enamel glass coating to exposed cabinet surfaces of refrigerators, washing machines, clothes dryers and the like. In addition, it is known to coat inner surfaces of oven cavities in a similar manner.

These appliance components are mostly made from sheet metal, with the sheet metal having a thickness defined by an elongated, peripheral edge. Typically, the components are formed through pressing and/or bending operations performed on the sheet metal. In any case, the elongated edge can be somewhat sharp as compared to the remaining portions of the component. However, these edges are generally not exposed such that direct contact with these portions is not a factor. Unfortunately, when a protective coating is applied to the component, such as a coating of porcelain enamel glass, the presence of these sharp portions can result in thin or bare coating spots. That is, during a normal spray application of a porcelain enamel slurry, the coating will accumulate unevenly along the sharp, elongated edges.

Furthermore, following a normal fusing process for the coating, the porcelain coating is normally in a compressive state, while the sheet metal substrate is in a tensile state. This condition develops due to the fact that the coefficient of thermal expansion for the porcelain enamel is lower than that for the steel. Therefore, a porcelain enamel glass coating is under continual stress. This normal state of stress is seldom a problem on generally flat portions of the coated component where the coating thickness is uniform. However, where the coating is non-uniform at the sharp, elongated edges, the stress concentration becomes critical such that spalling, chipping, fracturing, etc. tend to occur along these edge portions of the sheet metal component. Since chipped, fractured or the like areas are highly prone to rusting, avoiding this problem is needed.

Based on the above, there exists a need in the art of appliances to enhance the adherence of protective coatings applied to sheet metal components. More specifically, there exists a need for an improved method of producing appliance components from sheet metal which will enhance the adherence of a protective coating applied thereto, particularly at the elongated edges of the sheet metal component.

SUMMARY OF THE INVENTION

In accordance with the invention, an appliance component is formed from sheet metal having a thickness defined by an elongated edge portion. Prior to applying a coating, such as a porcelain enamel, to the component, the elongated edge portion of the sheet metal is rounded. Preferably, a high energy source, such as a tig welder, laser beam or plasma arc welder, is directed along the elongated edge portion to cause the desired rounding. In the most preferred form of the invention, the elongated edge portion is worked to develop a radiused or convexly curved cross-section. Following the rounding of the elongated edge portion, the coating is applied, preferably to the entire sheet metal component. With the rounding of the elongated edges, it has been found that a uniform coating, without thin or bare spots, can be readily formed.

Additional objects, features and advantages of the present invention will become more readily apparent from the following detailed description of a preferred embodiment wherein like reference numerals refer to corresponding parts in the several views.

BRIEF DESCRIPTION OF THE DRAWINGS

FIG. 1 is a perspective view of an appliance component, particularly a cover or lid member for a domestic washing machine, which has been produced in accordance with the present invention;

FIG. 2 is a cross-sectional view taken along line 3—3 of FIG. 1 but prior to the rounding of an elongated edge portion of the appliance component; and FIG. 3 is a cross-sectional view taken along line 3—3 of FIG. 1.

DETAILED DESCRIPTION OF THE PREFERRED EMBODIMENT

The present invention is particularly adapted for use in connection with the forming of an appliance component. With reference to FIG. 1, a preferred embodiment of the invention will be described in connection with an appliance component in the form of a cover or lid member 2 used to provide access to a washing basket of a conventional, household washing machine (not shown). However, although the invention will be described in detail with reference to this preferred embodiment, it should be understood that the invention has applicability to a wide range of components, particularly sheet metal components for a various types of appliances including refrigerators, clothes dryers, ranges and the like.

Lid member 2 is generally formed by shearing a piece of sheet metal. As shown, lid member 2 includes a main body portion 5 defined by a generally flat surface portion 8 and a front sloping surface portion 10. Lid member 2 also is shaped to include down-turned side walls 13 and 14, front wall 17 and a back wall 19. Side walls 13 and 14 are provided with respective apertures, one of which is indicated at 22, adjacent to back wall 19.

As best shown in FIGS. 2 and 3, the side, front and back walls 13, 14, 17 and 19 respectively, are bent so as to define an in-turned flange 25. Flange 25 actually constitutes the peripheral portion of the original sheet metal piece formed into lid member 2. In any event, flange 25 terminates in an elongated edge 29 which defines the thickness of the original sheet metal material. FIG. 2 illustrates elongated edge 29 as a generally sharp, squared off portion of lid member 25. It is this shape of elongated edge 29 which directly contributes to the problem of assuring an adequate adherence of a protective coating to be subsequently applied to lid member 2.

To address this problem, elongated edge 29 is rounded prior to the application of a protective coating. More specifically, a high energy source 34 is directed along the sharp, elongated edge 29 as represented in FIG. 2. In accordance with the most preferred form of the invention, high energy source 34 constitutes a plasma arc welder. For instance, a plasma weld system including a power supply operating in the range of approximately 0.5 to 75 amps, a plasma arc torch, a weld sequencer and interface, a closed circuit water cooling unit and clamping components could be used. However, other types high energy sources, including tig welding and laser beam sources, could also be employed. Plasma arc welding is preferred mainly due to the ease in which the arc can be directed unto the sharp elongated edge 29, while also representing a lower cost investment over other alternatives such as laser welding.

In preparation of coating lid member 2 in accordance with the invention, lid member 2 is initially clamped in a desired position. Next, 5 the high energy source 34 is positioned at elongated edge 29, preferably through robotic arm manipulation. Thereafter the high energy source 34 is moved along edge 29 to cause edge 29 to melt, whereby a rounding of elongated edge 29 as shown in FIG. 3 is produced. Lid member 2 is then cooled prior to applying a protective coating 40 upon lid member 2, 10 including elongated edge 29. In the most preferred form of the invention, a porcelain enamel glass coating 40 is applied through a sprayer 45 over the entire lid member 2. With the removal of the sharp elongated edge 29, the protective coating 40 can be substantially, uniformly applied to lid member 2. This uniformity will function to minimize any sheet metal surface exposure and undesirable rusting.

Although described with reference to a preferred embodiment of the invention, it should be readily understood that various changes and/or modifications may be made to the invention without departing from the spirit thereof. For instance, although porcelain is the preferred protective coating material in accordance with the invention, other known coating materials could be readily utilized. In addition, as indicated above, although the invention has been shown and described with reference to producing a washing machine component, it is to be understood that the invention has applicability on a wide range of metal components which may be subjected to corresponding rusting problems. Therefore, in general, the invention is only intended to be limited by the scope of the following claims.

We claim:

1. A method of producing an appliance component comprising:

forming the appliance component from sheet metal, with the sheet metal having a thickness defined by a peripheral, elongated edge portion;

rounding the elongated edge portion of the sheet metal; and applying a protective coating to the appliance component, including the elongated edge portion.

2. The method according to claim 1, wherein porcelain is applied as the protective coating.

3. The method according to claim 2, wherein the protective coating is sprayed onto the appliance component.

4. The method according to claim 1, wherein the elongated edge portion is rounded by directing a high energy source onto the elongated edge portion.

5. The method according to claim 4, wherein the high energy source is developed from the group consisting of a tig welder, laser beam and plasma arc welder.

6. The product prepared by the method of claim 1.

7. The product prepared by the method of claim 2.

8. The product prepared by the method of claim 3.

9. The product prepared by the method of claim 4.

10. The product prepared by the method of claim 5.

11. An appliance component comprising:

a sheet metal body having a thickness defined by a peripheral, elongated edge portion, said elongated edge portion being rounded; and a protective coating layer provided on the sheet metal body, including the elongated edge portion.

12. The appliance component according to claim 11, wherein the protective coating layer comprises porcelain.

13. The appliance component according to claim 11, wherein the elongated edge portion is convexly curved in cross-section.

* * * * *